US008267024B2

(12) United States Patent
Hayakawa et al.

(10) Patent No.: US 8,267,024 B2
(45) Date of Patent: Sep. 18, 2012

(54) SEWING MACHINE AND COMPUTER-READABLE MEDIUM STORING CONTROL PROGRAM EXECUTABLE ON SEWING MACHINE

(75) Inventors: Atsuya Hayakawa, Chita (JP); Masashi Tokura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 669 days.

(21) Appl. No.: 12/320,340

(22) Filed: Jan. 23, 2009

(65) Prior Publication Data

US 2009/0194008 A1 Aug. 6, 2009

(30) Foreign Application Priority Data

Jan. 24, 2008 (JP) ..... 2008-013439

(51) Int. Cl.
*D05B 19/00* (2006.01)

(52) U.S. Cl. ..... 112/470.04; 112/470.01; 700/136

(58) Field of Classification Search ..... 700/136–138; 112/102.5, 470.01, 470.06, 475.19, 470.04
See application file for complete search history.

(56) References Cited

U.S. PATENT DOCUMENTS

| | | | | |
|---|---|---|---|---|
| 4,998,489 | A * | 3/1991 | Hisatake et al. | 112/470.04 |
| 5,095,835 | A * | 3/1992 | Jernigan et al. | 112/470.04 |
| 5,911,182 | A * | 6/1999 | Uyama et al. | 112/102.5 |
| 6,263,815 | B1 * | 7/2001 | Furudate | 112/470.13 |
| 7,164,786 | B2 | 1/2007 | Katayama et al. | |
| 7,307,655 | B1 | 12/2007 | Okamoto et al. | |
| 7,538,798 | B2 | 5/2009 | Mizusawa | |
| 2006/0015209 | A1 * | 1/2006 | Schweizer | 700/136 |

FOREIGN PATENT DOCUMENTS

| | | |
|---|---|---|
| JP | A-03-099952 | 4/1991 |
| JP | A-08-024464 | 1/1996 |
| JP | A-08-048198 | 2/1996 |
| JP | A-08-071287 | 3/1996 |
| JP | A-09-114979 | 5/1997 |
| JP | A-09-305796 | 11/1997 |
| JP | A-2000-215311 | 8/2000 |
| JP | B2-3138080 | 2/2001 |
| JP | B2-3286306 | 5/2002 |
| JP | A-2002-232948 | 8/2002 |
| JP | A-2003-256874 | 9/2003 |

OTHER PUBLICATIONS

Mar. 6, 2012 Office Action issued in Japanese Patent Application No. 2008-013439 (with nglish Translation).

Japanese Office Action issued in Japanese Application No. 2008-013439 dated Jun. 12, 2012 (with translation).

* cited by examiner

*Primary Examiner* — Nathan Durham
(74) *Attorney, Agent, or Firm* — Oliff & Berridge, PLC

(57) ABSTRACT

A sewing machine includes a bed portion, a pillar portion that is erected upward from the bed portion, an arm portion that extends horizontally from the pillar portion above the bed portion, a head that is provided at an end of the arm portion, a needle bar that is attached to the head and can reciprocate up and down, an image pickup device that can pick up an image of an upper surface of the bed portion, an image conversion device that generates a virtual image from a real image by viewpoint conversion, the virtual image being an image as viewed from an arbitrary viewpoint position, and the real image being an image picked up by the image pickup device, an image display device that displays an image, and an image display control device that displays the virtual image generated by the image conversion device on the image display device.

22 Claims, 12 Drawing Sheets

SEWING MACHINE AND COMPUTER-READABLE MEDIUM STORING CONTROL PROGRAM EXECUTABLE ON SEWING MACHINE

CROSS-REFERENCE TO RELATED APPLICATION

This application claims priority to JP 2008-013439, filed Jan. 24, 2008, the content of which is hereby incorporated herein by reference in its entirety.

BACKGROUND

The present disclosure relates to a sewing machine which allows a display device to display an image and a computer-readable medium storing a control program executable on the sewing machine.

Conventionally, a sewing machine has been known which includes an image pickup device that picks up an image and a display device that displays the image picked up by the image pickup device. For example, in a sewing machine described in Japanese Patent Application Laid-Open Publication No. Hei 8-71287, an image of the vicinity of a needle drop point of a sewing needle is picked up by the image pickup device. Then, a needle drop point position is displayed together with the picked-up image on the display device. Therefore, a user can confirm a needle position and a sewn state without bringing the user's face close to the needle drop point. Moreover, the user can easily confirm the needle position and the sewn state without the user's view being blocked by a part such as a presser foot.

SUMMARY

In the sewing machine described in Japanese Patent Application Laid Open Publication No. Hei 8-71287, the image pickup device is disposed at a predetermined position in the sewing machine. Accordingly, the image pickup device does not allow the display device to display an image as viewed from a different viewpoint from the position where the image pickup device is placed. Therefore, to confirm the needle position and the sewn state from the different viewpoint, the user has to bring the user's face close to the needle drop point.

Various exemplary embodiments of the broad principles derived herein provide a sewing machine which allows the user to easily confirm a needle position and a sewn state from an viewpoint and a computer-readable medium storing a control program executable on the sewing machine.

Exemplary embodiments provide a sewing machine that includes a bed portion, a pillar portion that is erected upward from the bed portion, an arm portion that extends horizontally from the pillar portion above the bed portion, a head that is provided at an end of the arm portion, a needle bar that is attached to the head and can reciprocate up and down, and to which a sewing needle is attached, an image pickup device that can pick up an image of an upper surface of the bed portion, an image conversion device that generates a virtual image from a real image by viewpoint conversion, the virtual image being an image as viewed from an arbitrary viewpoint position, and the real image being an image picked up by the image pickup device, an image display device that displays an image, and an image display control device that displays the virtual image generated by the image conversion device on the image display device.

Exemplary embodiments provide a computer-readable medium storing a control program executable on a sewing machine. The program includes instructions that cause a controller to perform the steps of acquiring a real image that is a picked-up image of an upper surface of a bed portion of the sewing machine, generating a virtual image as viewed from an arbitrary viewpoint position from the acquired real image by viewpoint conversion, and displaying the generated virtual image.

Other objects, features, and advantages of the present disclosure will be apparent to persons of ordinary skill in the art in view of the following detailed description of embodiments of the invention and the accompanying drawings.

BRIEF DESCRIPTION OF THE DRAWINGS

Exemplary embodiments will be described below in detail with reference to the accompanying drawings in which.

DETAILED DESCRIPTION

Figure 2:
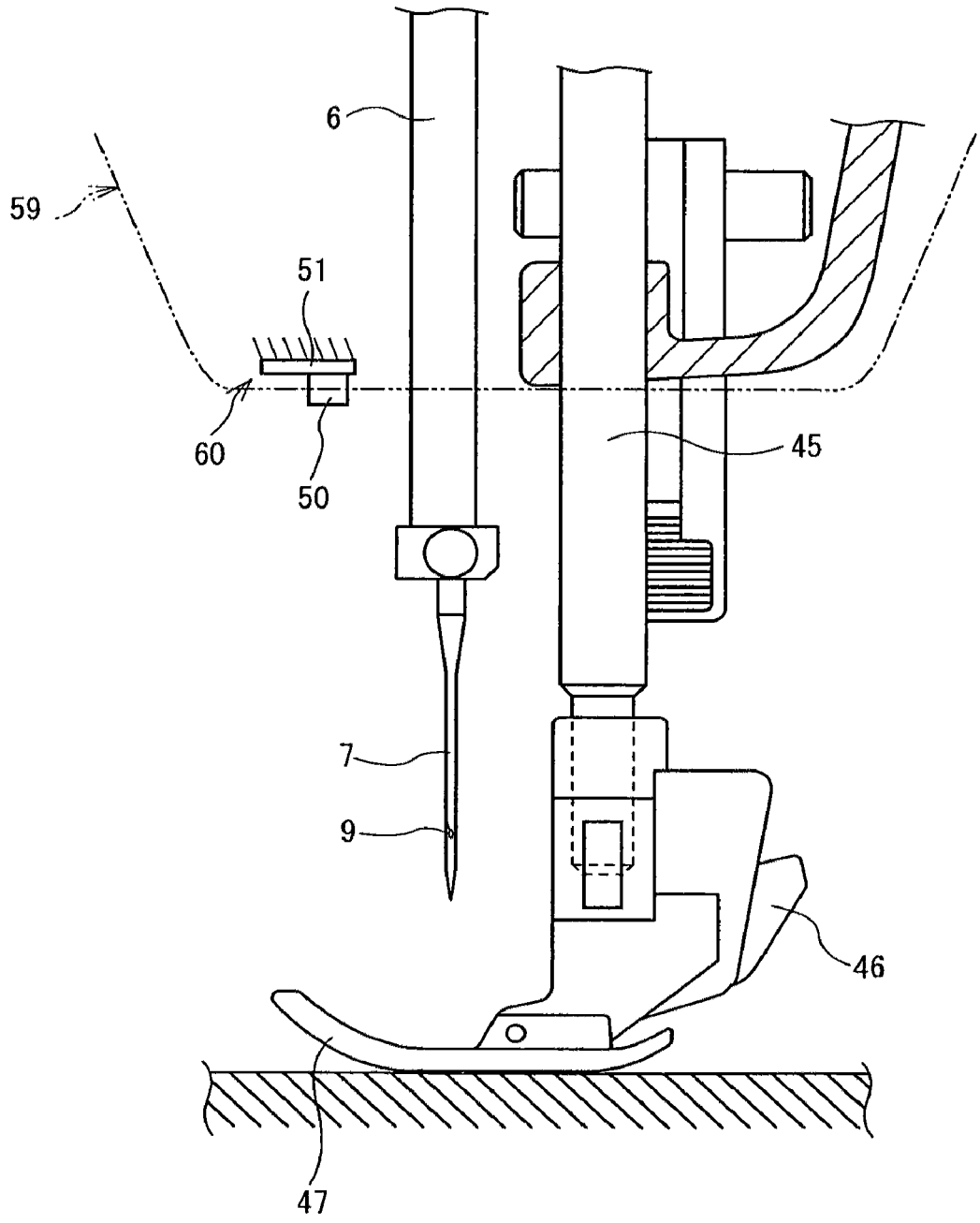
FIG. 2 is a schematic view that shows an image sensor.
Figure 3:
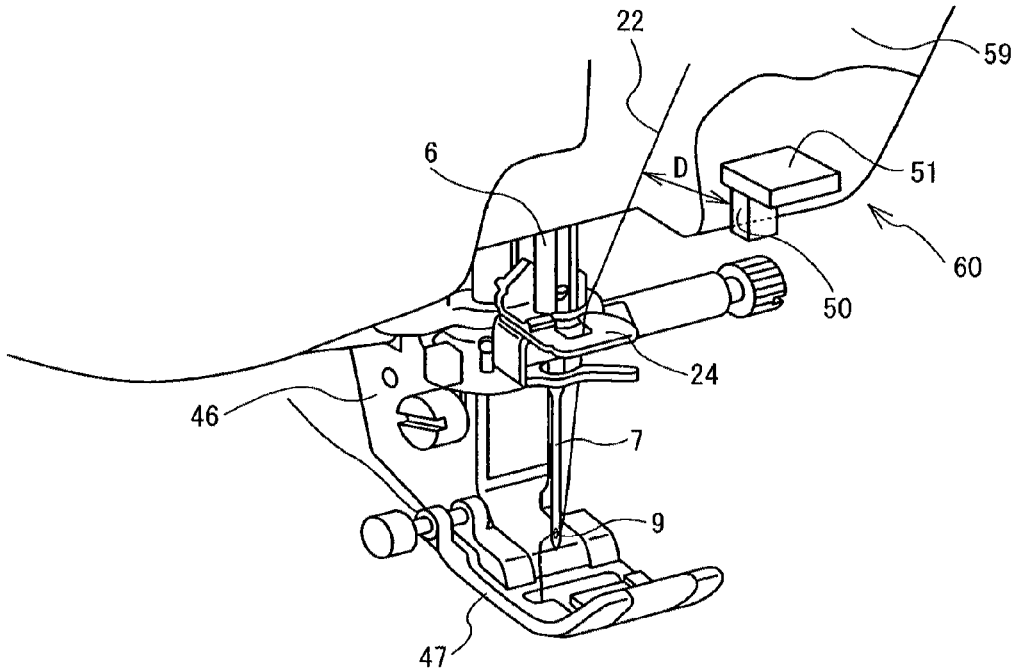
FIG. 3 is a schematic view that shows a positional relationship between the image sensor and a thread guide path of a needle thread.

The following will describe embodiments of the present disclosure with reference to the drawings. A physical configuration and an electrical configuration of a sewing machine 1 will be described below with reference to FIGS. 1 to 4. The side of the page that faces toward the user in FIG. 1, the left side of the page of FIG. 2, and the lower right side of the page of FIG. 3 are referred to as a front side of the sewing machine 1.

Figure 1:
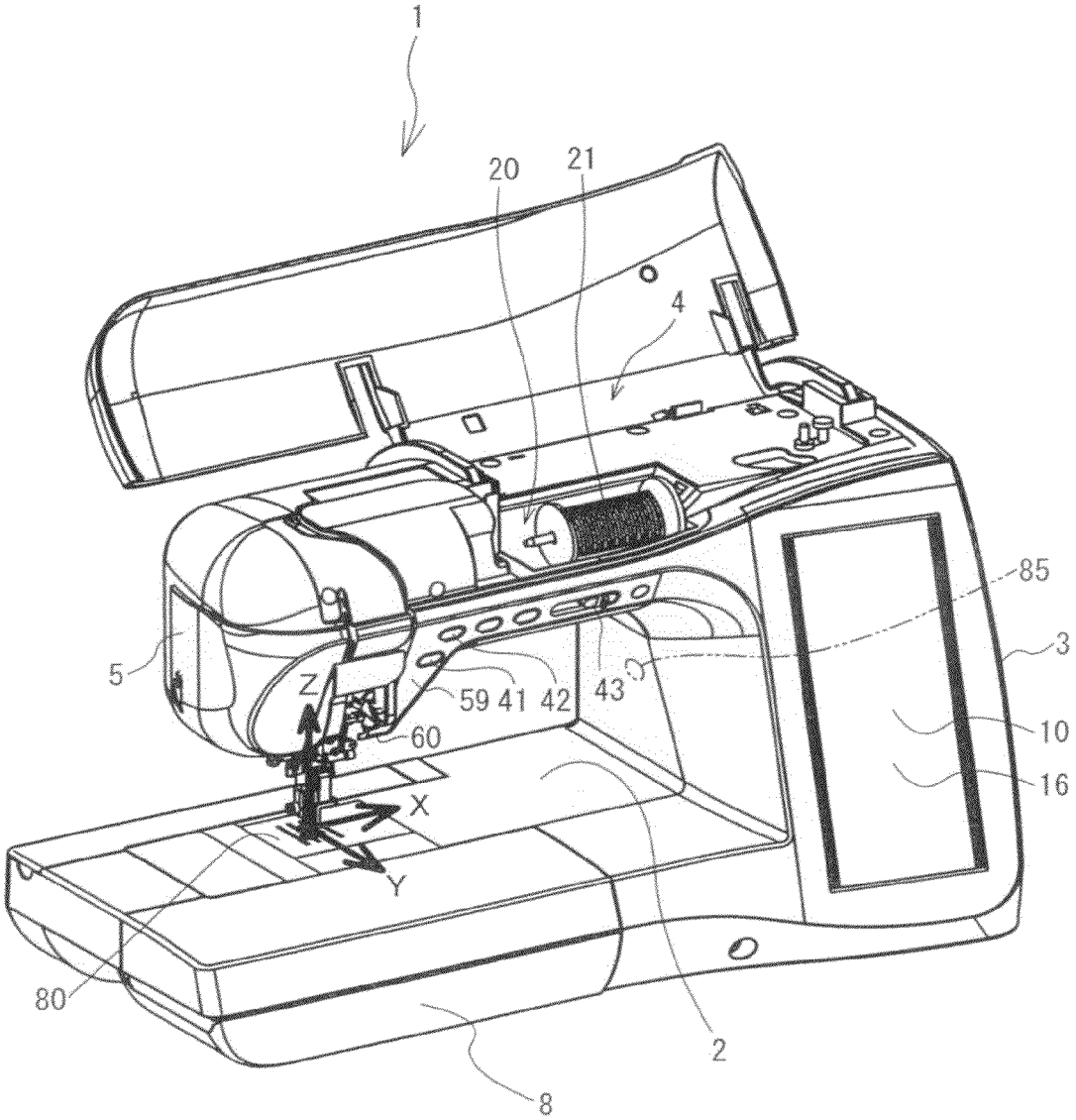
FIG. 1 is a perspective view that shows a sewing machine as viewed from above.

The physical configuration of the sewing machine 1 according to the present embodiment will be described below with reference to FIG. 1. As shown in FIG. 1, the sewing machine 1 includes a sewing machine bed 2, a pillar 3, an arm 4, and a head 5. The sewing machine bed 2 extends in the right-and-left directions. The pillar 3 is erected upward at the right end of the sewing machine bed 2. The arm portion 4 extends leftward from the upper end of the pillar 3. The head 5 is provided at the left end of the arm 4. A liquid crystal display (LCD) 10 is provided on a front surface of the pillar 3. A touch panel 16 is provided on a surface of the LCD 10. The LCD 10 displays an input key etc. used for inputting a sewing pattern, sewing conditions, etc. The user touches a position corresponding to the displayed input key etc. on the touch panel 16 to select a sewing pattern, a sewing condition, etc. Further, in a case where a virtual image is generated by viewpoint conversion from a real image picked up by an image sensor 50 (see FIGS. 2 and 3) and the generated virtual image is displayed, a viewpoint change screen is displayed on the LCD 10. The viewpoint change screen is used to accept an input of a viewpoint position which is entered by the user. The viewpoint change screen will be described in detail below with reference to FIG. 9. An image picked up by the image sensor 50 is hereinafter referred to as a "real image". A virtual image is an image as viewed from a viewpoint that is desired by the user.

The sewing machine 1 contains a sewing machine motor 79 (see FIG. 4), a drive shaft (not shown), a needle bar 6 (see FIGS. 2 and 3), a needle bar up-and-down movement mechanism (not shown), a needle bar swinging mechanism (not shown), etc. A sewing needle 7 is attached to the lower end of the needle bar 6. The needle bar up-and-down movement mechanism moves the needle bar 6 up and down. The needle bar swinging mechanism swings the needle bar 6 in the right-and-left directions. A thread spool mounting portion 20 is formed in the upper portion of the arm 4. A thread spool 21 to be used in sewing is set in the thread spool mounting portion 20.

A needle plate 80 is placed on the top portion of the sewing machine bed 2. The sewing machine bed 2 contains a feed dog back-and-forth movement mechanism (not shown), a feed dog up-and-down movement mechanism (not shown), a feed adjustment pulse motor 78 (see FIG. 4), a shuttle (not shown), etc. below the needle plate 80. The feed dog back-and-forth movement mechanism and the feed dog up-and-down movement mechanism drive a feed dog (not shown). The feed adjustment pulse motor 78 adjusts a feed distance of a work cloth fed by the feed dog. The shuttle houses a bobbin around which a bobbin thread is wound. A side table 8 is fitted to the left of the sewing machine bed 2. The side table 8 can be detached from the sewing machine bed 2. If the side table 8 is detached from the sewing machine bed 2, an embroidery unit (not shown) can be attached to the sewing machine bed 2 instead.

A pulley (not shown) is mounted on the right side surface of the sewing machine 1. The pulley is used for rotating the drive shaft manually so that the needle bar 6 may be moved up and down. A front surface cover 59 is placed over the front surface of the head 5 and the arm 4. A sewing start-and-stop switch 41, a reverse stitch switch 42, a speed controller 43, and other operation switches are provided on the front surface cover 59. The sewing start-and-stop switch 41 is used to instruct the sewing machine 1 to start or stop driving the sewing machine motor 79 so that sewing may be started or stopped. The reverse stitch switch 42 is used to feed a work cloth in the reverse direction, that is, from the rear side to the front side. The speed controller 43 is used to adjust a sewing speed (a rotation speed of the drive shaft). When the sewing start-and-stop switch 41 is pressed while the sewing machine 1 is stopped, the sewing machine 1 is started. When the sewing start-and-stop switch 41 is pressed while the sewing machine 1 is operating, the sewing machine 1 is stopped. Further, the image sensor 50 (see FIGS. 2 and 3) is disposed at the lower end portion 60 inside of the front surface cover 59, which is the diagonally upper right position of the sewing needle 7 as viewed from the front side. The image sensor 50 can pick up an image of the needle plate 80 on the sewing machine bed 2 and the vicinity of the needle plate 80.

The image sensor 50 will be described below with reference to FIGS. 2 and 3. The image sensor 50 is a known CMOS image sensor and picks up an image. In the present embodiment, as shown in FIGS. 2 and 3, a support frame 51 is attached to the lower end portion 60 inside of the front surface cover 59. To the support frame 51, the image sensor 50 is disposed to face downward to pick up an image over the sewing machine bed 2. As shown in FIG. 3, a needle bar thread guide 24 leads a needle thread 22 pulled from the thread spool 21 (see FIG. 1) to the sewing needle 7, and the needle thread 22 is passed through a needle eye 9 of the sewing needle 7. The image sensor 50 is positioned at a predetermined distance D from a thread guide path of the needle thread 22 and disposed forward of the needle bar 6. Accordingly, the thread guide path of the needle thread 22 is not an obstacle to an image pickup by the image sensor, and the image sensor 50 can pick up an image from the front side of the needle bar 6, which is closer to the user's viewpoint. Therefore, the user can easily know the positional relationship of objects in a displayed image without being bothered. As shown in FIG. 2, a presser foot 47, which holds down a work cloth, is attached to a presser holder 46, which is fixed to the lower end of a presser bar 45. The sewing machine 1 according to the present embodiment employs a small-sized and inexpensive CMOS image sensor as the image sensor 50 so that an installation space and production costs of the image sensor 50 may be reduced. However, the image sensor 50 is not limited to the CMOS image sensor. The image sensor 50 may be a CCD camera or any other image pickup device.

Figure 4:
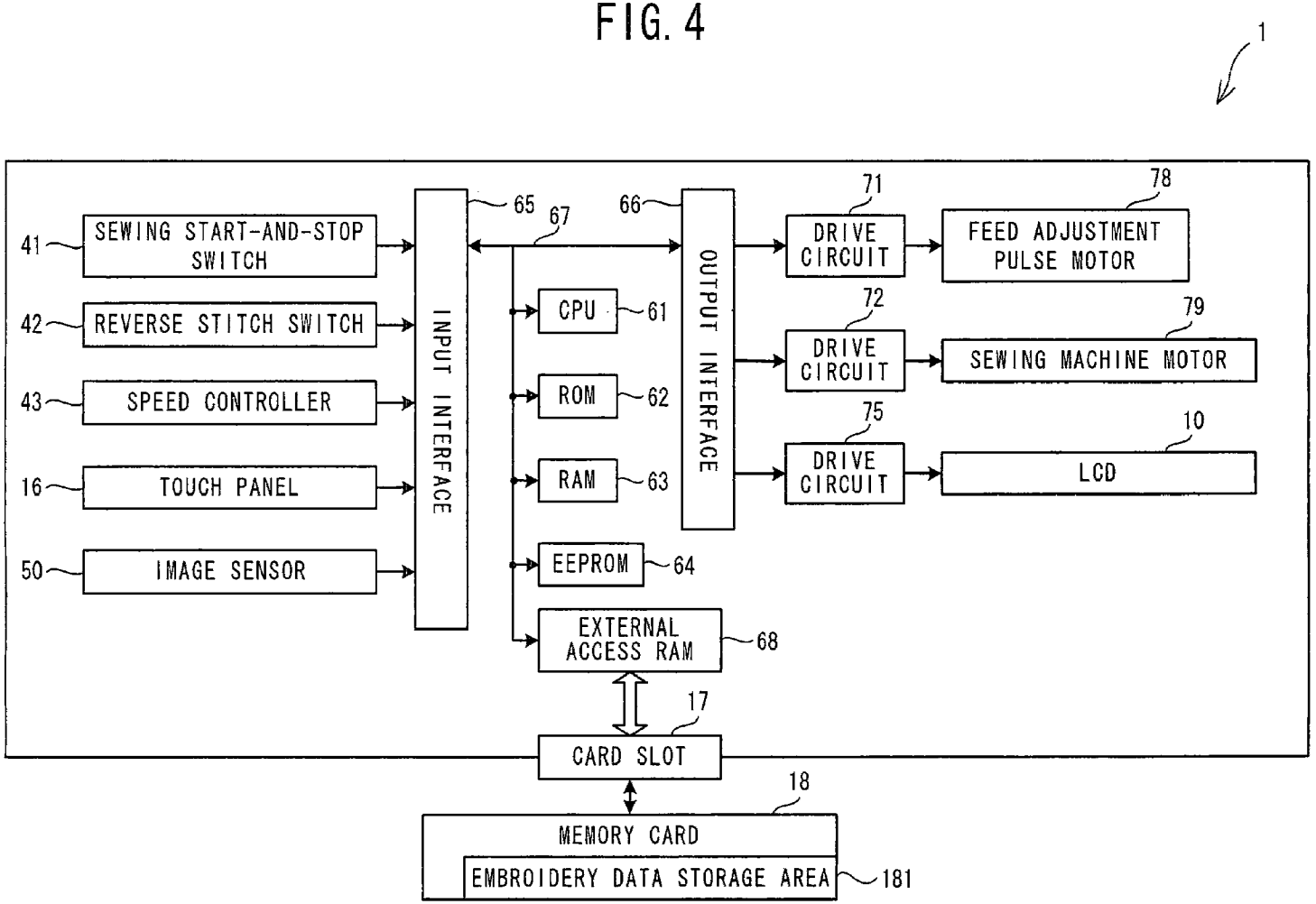
FIG. 4 is a block diagram that shows an electrical configuration of the sewing machine.

The electrical configuration of the sewing machine 1 will be described below with reference to FIG. 4. As shown in FIG. 4, the sewing machine 1 includes a CPU 61, an ROM 62, an RAM 63, an EEPROM 64, a card slot 17, an external access RAM 68, an input interface 65, an output interface 66, etc., which are mutually connected via a bus 67. Connected to the input interface 65 are the sewing start-and-stop switch 41, the reverse stitch switch 42, the speed controller 43, the touch panel 16, the image sensor 50, etc. Drive circuits 71, 72, and 75 are electrically connected to the output interface 66. The drive circuit 71 drives the feed adjustment pulse motor 78. The drive circuit 72 drives the sewing machine motor 79, which rotationally drives the drive shaft. The drive circuit 75 drives the LCD 10. The card slot 17 is configured to be connected with a memory card 18. The memory card 18 includes an embroidery data storage area 181 to store embroidery data that is used for embroidering with the sewing machine 1.

The CPU 61 performs main control over the sewing machine 1. The CPU 61 performs various kinds of computation and processing in accordance with a control program stored in a control program storage area of the ROM 62, which is a read only memory. The RAM 63, which is a readable and writable random access memory, includes a real image storage area, a changed viewpoint coordinates storage area, and other miscellaneous data storage areas as required. The real image storage area stores a real image that is picked up by the image sensor 50. The changed viewpoint coordinates storage area stores coordinates of a viewpoint position that is changed by the user. The miscellaneous data storage areas store results of the computation and processing performed by the CPU 61.

Figure 5:
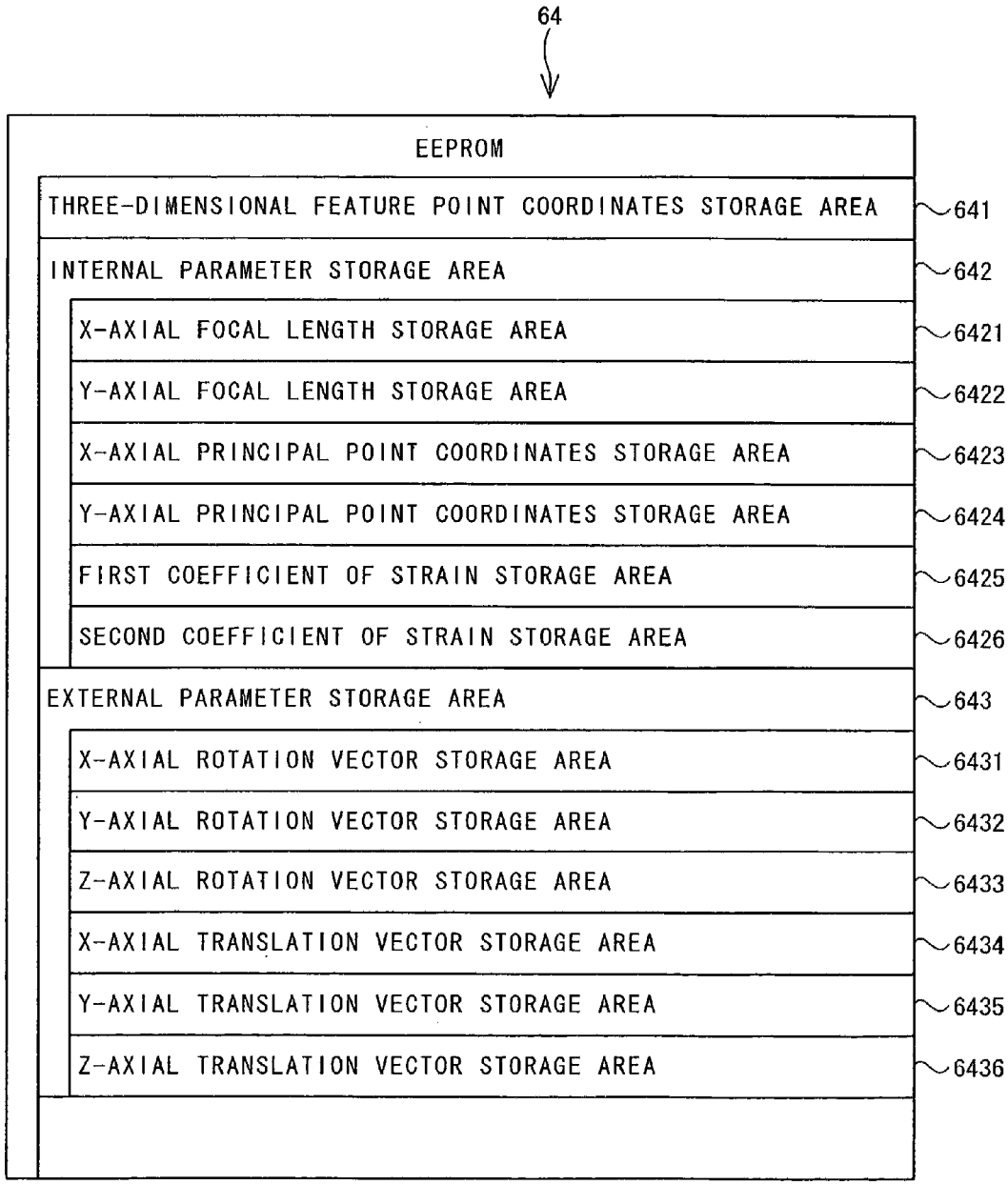
FIG. 5 is a schematic diagram that shows a configuration of storage areas that are provided in an EEPROM.

The storage areas included in the EEPROM 64 will be described below with reference to FIG. 5. The EEPROM 64 includes a three-dimensional feature point coordinates storage area 641, an internal parameter storage area 642, and an external parameter storage area 643.

The three-dimensional feature point coordinates storage area 641 stores three-dimensional coordinates of a feature point on the needle plate 80 in a world coordinate system. The three-dimensional coordinates of the feature point are calculated beforehand and used for calculating various parameters, as described below, in the sewing machine 1. The world coordinate system is a three-dimensional coordinate system which is mainly used in the field of three-dimensional graphics and which represents the whole of space. The world coordinate system is not influenced by the center of gravity etc. of a subject. Accordingly, the world coordinate system is used to indicate a position of an object or to compare coordinates of different objects in space. In the present embodiment, as shown in FIG. 1, an upper surface of the sewing machine bed 2 is defined as an XY plane, and a specific point on the needle plate 80 is defined as an origin (0, 0, 0), thereby the world coordinate system is established. The up-and-down directions, the right-and-left directions, and the front-and-rear directions of the sewing machine 1 with respect to the origin are defined as a Z-axis, an X-axis, and a Y-axis, respectively.

The internal parameter storage area 642 includes an X-axial focal length storage area 6421, a Y-axial focal length storage area 6422, an X-axial principal point coordinates storage area 6423, a Y-axial principal point coordinates storage area 6424, a first coefficient of strain storage area 6425, and a second coefficient of strain storage area 6426. The external parameter storage area 643 includes an X-axial rotation vector storage area 6431, a Y-axial rotation vector storage area 6432, a Z-axial rotation vector storage area 6433, an X-axial translation vector storage area 6434, a Y-axial translation vector storage area 6435, and a Z-axial translation vector storage area 6436.

The parameters will be described below. The parameters stored in the EEPROM 64 may be used for generating a virtual image as viewed from an arbitrary viewpoint from a real image by the viewpoint conversion and converting three-dimensional coordinates into two-dimensional coordinates, and vice versa. The parameters are calculated by a known camera calibration parameter calculation method, based on a combination of two-dimensional coordinates of the feature point, which is calculated from a picked-up image of the needle plate 80, and the three-dimensional coordinates of the feature point, which is stored in the three-dimensional feature point coordinates storage area 641. More specifically, an image of a subject (the needle plate 80 in the present embodiment) including a feature point, three-dimensional coordinates of which are given, is picked up by a camera (the image sensor 50 in the present embodiment), and the two-dimensional coordinates of the feature point in the picked-up image is calculated. Then, a projection matrix is obtained based on the given three-dimensional coordinates and the calculated two-dimensional coordinates, and the parameters are obtained from the obtained projection matrix. Various methods of calculating parameters for camera calibration have been studied and proposed. For example, Japanese Patent No. 3138080 discloses a method of calculating parameters for camera calibration, the relevant portions of which are hereby incorporated by reference. In the present disclosure, any one of the calculation methods may be employed. In the present embodiment, the parameters are calculated in the sewing machine 1 and the calculated parameters are stored in the EEPROM 64. However, the parameters may be calculated beforehand and the calculated parameters may be stored at the factory.

An internal parameter is used for correcting a shift in focal length, a shift in principal point-coordinates or strain of a picked-up image, which are caused by properties of the image sensor 50. In the present embodiment, the following six internal parameters is used: an X-axial focal length, a Y-axial focal length, an X-axial principal point coordinate, a Y-axial principal point coordinate, a first coefficient of strain, and a second coefficient of strain. In a case of dealing with a real image, which is picked up by the image sensor 50, the following cases may occur. For example, the center position of the image may be unclear. For example, in a case where pixels of the image sensor 50 are not square-shaped, the two coordinate axes of the image may have different scales. For example, the two coordinate axes of the image may not be orthogonal to each other. Therefore, the concept of a "normalized camera" is introduced, which picks up an image at a position which is a unit length away from a focal point of the normalized camera in a condition where the two coordinate axes have the same scale and are orthogonal to each other. An image picked up by the image sensor 50 is converted into a normalized image, which is an image that is assumed to have been picked up by the normalized camera. The internal parameters are used for converting the real image into the normalized image.

The X-axial focal length is an internal parameter that represents an x-axis directional shift of the focal length of the image sensor 50. The Y-axial focal length is an internal parameter that represents a y-axis directional shift of the focal length of the image sensor 50. The X-axial principal point coordinate is an internal parameter that represents an x-axis directional shift of the principal point of the image sensor 50. The Y-axial principal point is an internal parameter that represents a y-axis directional shift of the principal point of the image sensor 50. The first coefficient of strain and the second coefficient of strain are internal parameters that represent strain due to the inclination of a lens of the image sensor 50.

An external parameter indicates an installation condition (position and direction) of the image sensor 50 with respect to the world coordinate system. That is, the external parameter indicates a shift of the three-dimensional coordinate system in the image sensor 50 with respect to the world coordinate system. The three-dimensional coordinate system in the image sensor 50 is hereinafter referred to as a "camera coordinate system." In the present embodiment, the following six external parameters are calculated: an X-axial rotation vector, a Y-axial rotation vector, a Z-axial rotation vector, an X-axial translation vector, a Y-axial translation vector, and a Z-axial translation vector. The camera coordinate system of the image sensor 50 may be converted into the world coordinate system with the external parameters. The X-axial rotation vector represents a rotation of the camera coordinate system around the X-axis with respect to the world coordinate system. The Y-axial rotation vector represents a rotation of the camera coordinate system around the Y-axis with respect to the world coordinate system. The Z-axial rotation vector represents a rotation of the camera coordinate system around the Z-axis with respect to the world coordinate system. The X-axial rotation vector, the Y-axial rotation vector, and the Z-axial rotation vector are used to determine a conversion matrix that is used to convert coordinates in the world coordinate system into coordinates in the camera coordinate system, and vice versa. The X-axial translation vector represents an x-axial shift of the camera coordinate system with respect to the world coordinate system. The Y-axial translation vector represents a y-axial shift of the camera coordinate system with respect to the world coordinate system. The Z-axial translation vector represents a z-axial shift of the camera coordinate system with respect to the world coordinate system. The X-axial translation vector, the Y-axial translation vector, and the Z-axial translation vector are used to determine a translation vector that is used to convert coordinates in the world coordinate system into coordinates in the camera coordinate system, and vice versa.

Image display processing will be described below with reference to FIGS. 6 to 10. In the sewing machine 1 of the present embodiment, an image that is picked up by the image sensor 50 may be displayed as it is on the LCD 10 as a real image. A virtual image as viewed from an arbitrary viewpoint that is desired by the user may be generated from the real image by the viewpoint conversion, and the generated virtual image may be displayed. Accordingly, the user can confirm a needle position and a sewn state on the LCD 10 from an arbitrary viewpoint without many image sensors 50 disposed on the sewing machine 1.

Figure 6:
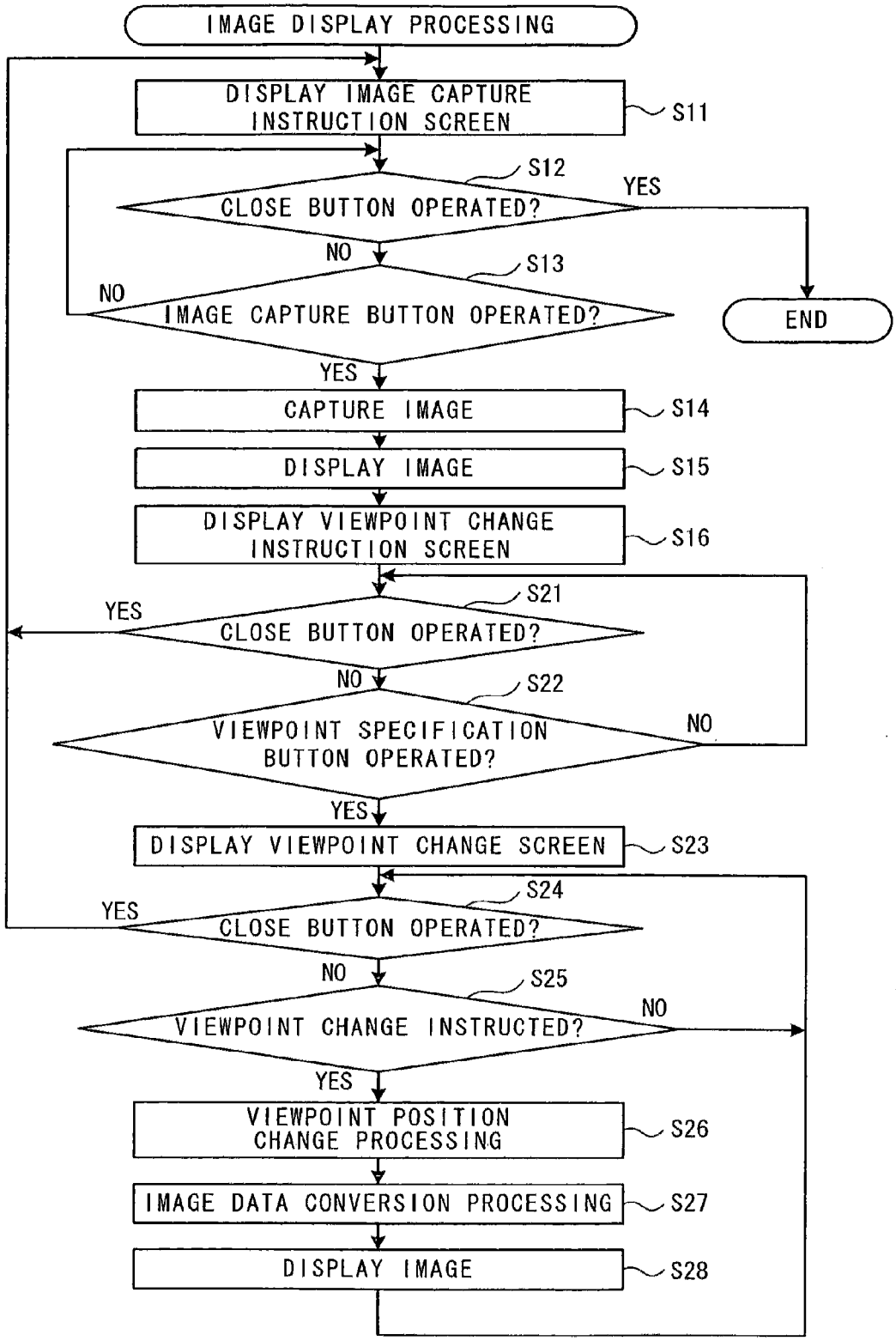
FIG. 6 is a flowchart of image display processing that is performed in the sewing machine.
Figure 7:
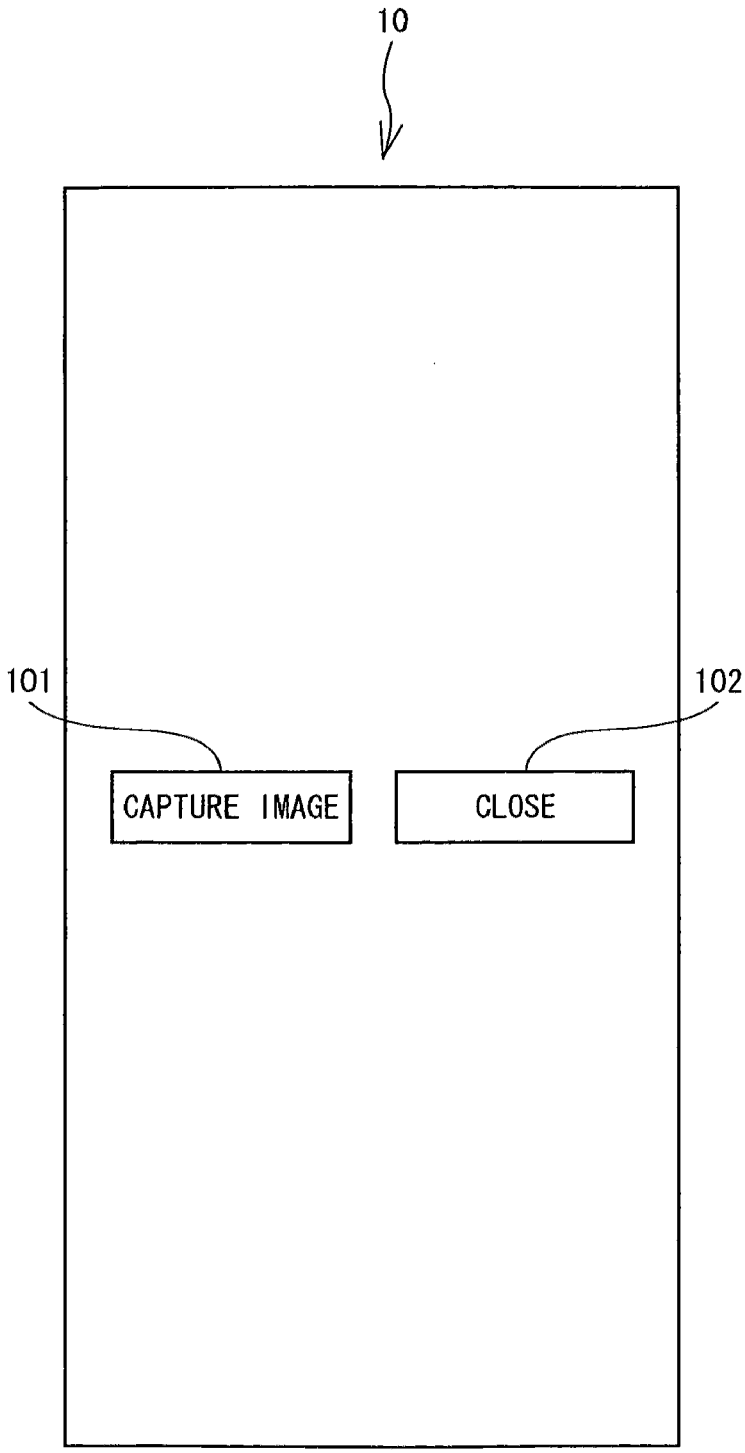
FIG. 7 is an illustration that shows an example of an image capture instruction screen that is displayed on a liquid crystal display (LCD)

When the user operates the touch panel 16 to select an "image data capture by camera" function, the image display processing starts, as shown in a flowchart of FIG. 6. The image display processing is performed by the CPU 61 according to the control program stored in the control program storage area of the ROM 62. First, in order to pick up an image at a timing desired by the user, an image capture instruction screen is displayed on the LCD 10 (step S11). As shown in FIG. 7, the image capture instruction screen includes an image capture button 101, with which the user gives an instruction of image capture, and a close button 102, which is used for terminating the image display processing.

Subsequently, the CPU 61 determines whether the close button 102 is operated (step S12). If the user touches a portion, corresponding to the close button 102, on the touch panel 16 and the close button 102 is operated (YES at step S12), the CPU 61 terminates the image display processing. If the close button 102 is not operated (NO at step S12), the CPU 61 determines whether the image capture button 101 is operated (step S13). If the image capture button 101 is not operated (NO at step S13), the CPU 61 returns to the determination of step S12.

Figure 8:
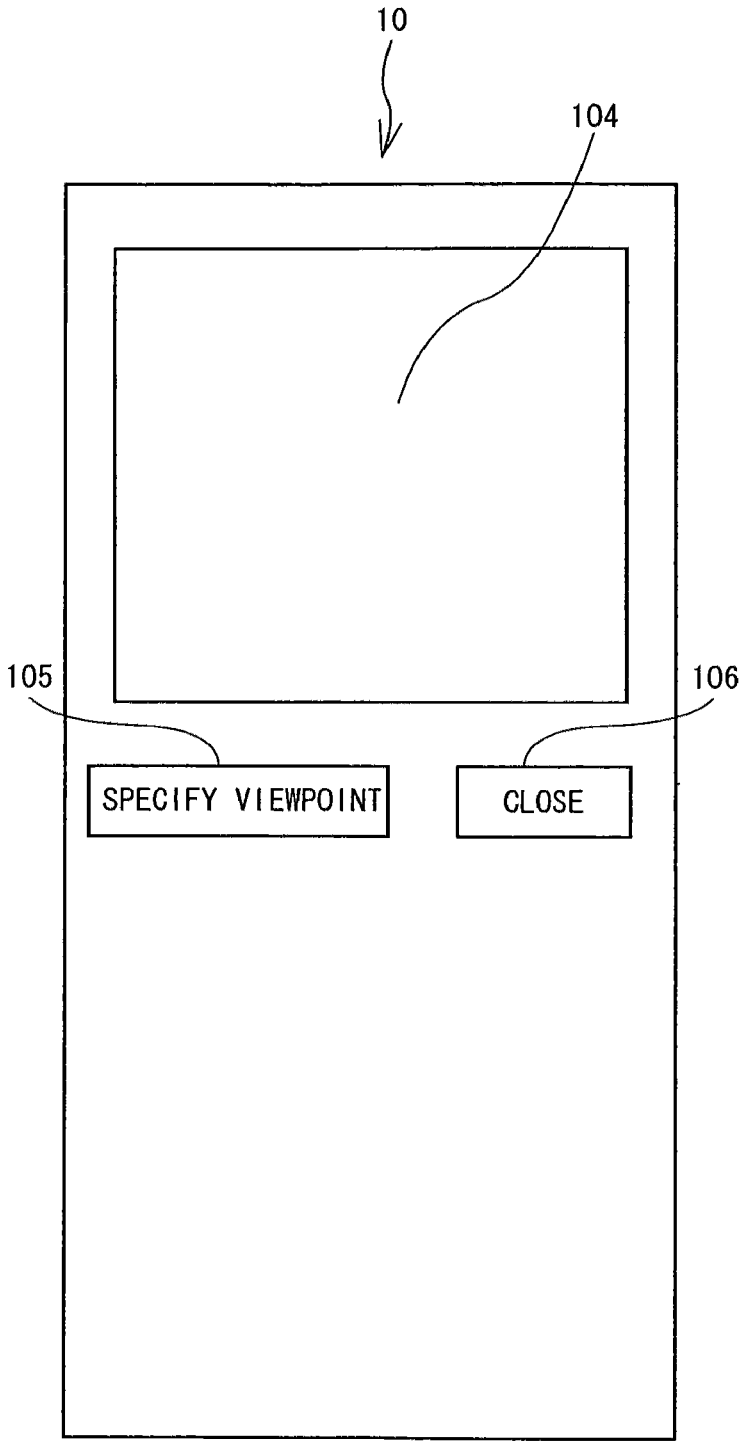
FIG. 8 is an illustration that shows an example of a viewpoint change instruction screen that is displayed on the LCD.

If the image capture button 101 is operated (YES at step S13), an image is picked up by the image sensor 50 and the picked-up image is stored as a real image in the real image storage area of the RAM 63 (step S114). Subsequently, the picked-up real image is displayed in an image display region 104 (see FIG. 8), which is provided in a substantially upper half portion of the LCD 10 (step S15). Further, on the LCD 10, a viewpoint change instruction screen appears to prompt the user to determine whether or not to perform the viewpoint conversion (step S16). As shown in FIG. 8, the viewpoint change instruction screen includes a viewpoint specification button 105, with which the user gives an instruction to perform the viewpoint conversion, and a close button 106, which is used for exiting image display.

Subsequently, the CPU 61 determines whether the close button 106 is operated (step S21). If the close button 106 is operated (YES at step S21), the CPU 61 returns to processing of step S11. If the close button 106 is not operated (NO at step S21), the CPU 61 determines whether the viewpoint specification button 105 is operated (step S22). If neither the viewpoint specification button 105 nor the close button 106 is operated (NO at step S22), the CPU 61 returns to processing of step S21. If the viewpoint specification button 105 is operated (YES at step S22), the viewpoint change screen to receive user's instruction to change an image viewpoint position appears on the LCD 10 (step S23).

Figure 9:
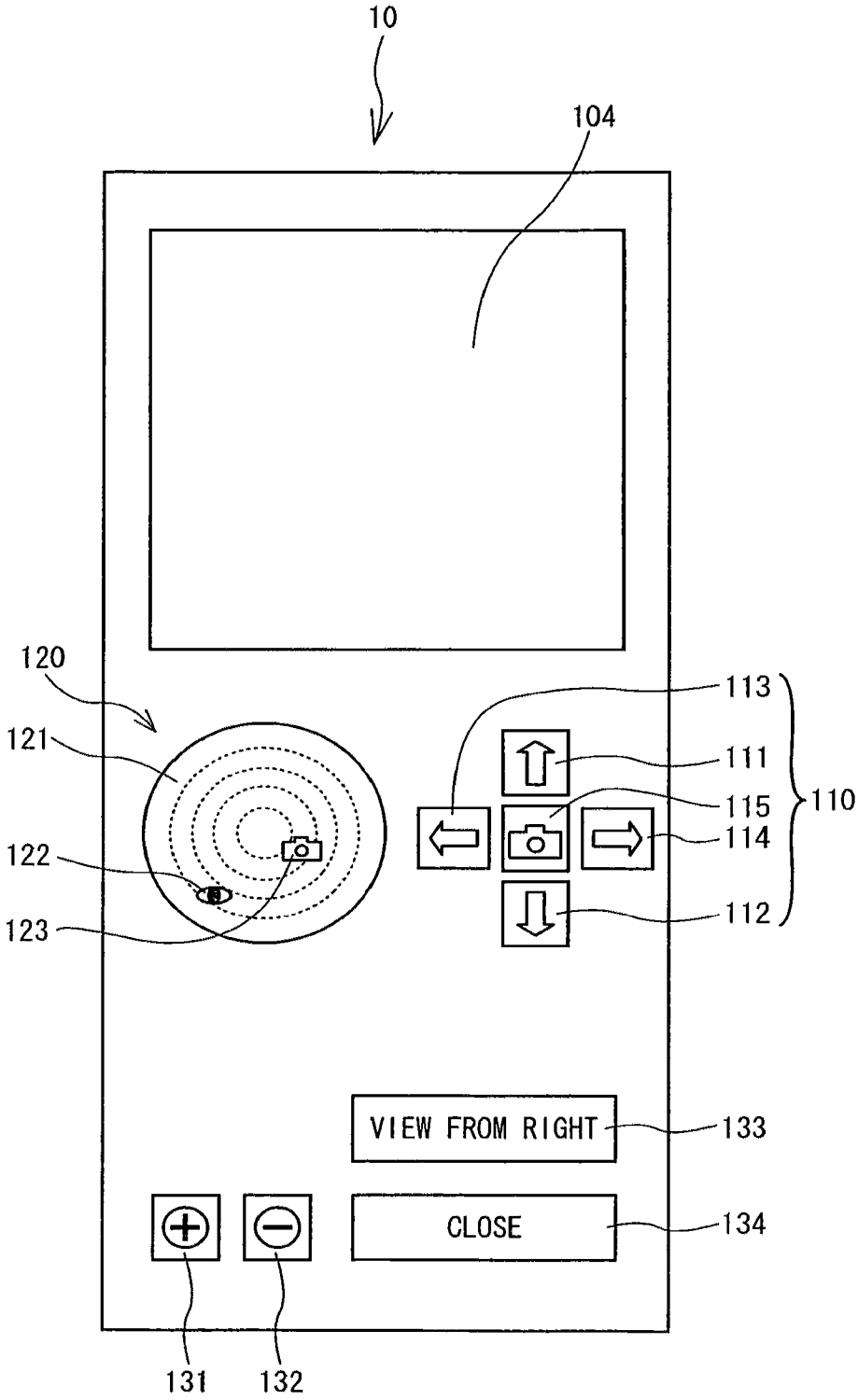
FIG. 9 is an illustration that shows an example of a viewpoint change screen that is displayed on the LCD.

FIG. 9 shows an example of the viewpoint change screen. The LCD 10 displays viewpoint movement buttons 110, a viewpoint position display region 120, a zoom in button 131, a zoom out button 132, a specific viewpoint button 133, and a close button 134. The viewpoint movement buttons 110, which includes an up button 111, a down button 112, a left button 113, a right button 114, and a reset button 115, are used by the user to move the viewpoint position. The reset button 115 is used to return the viewpoint position to its original position. Accordingly, if the reset button 115 is operated, a displayed image is changed from a virtual image to a real image. If the user presses any one of the up button 111, the down button 112, the left button 113, and the right button 114, the viewpoint position is moved in a direction indicated by the pressed button. By simultaneously pressing either one of the up button 111 and the down button 112 and either one of the left button 113 and the right button 114, the viewpoint position may be moved in a direction which is inclined by 45 degrees with respect to any one of the upper, lower, left, and right directions. Although not shown, four 45-degree-inclined-arrow buttons may be added to the viewpoint movement buttons 110 to make an eight-directional one.

The viewpoint position display region 120 shows a plurality of concentric circles 121 the center of which is a needle drop point. The needle drop point refers to a point on a work cloth at which the sewing needle 7 is affixed to and through the work cloth after moved downward by the needle bar up-and-down movement mechanism. In the viewpoint position display region 120, a viewpoint position is indicated by a viewpoint mark 122 and a position where the image sensor 50 is placed is indicated by a camera mark 123. Therefore, the user can easily know a positional relationship among the needle drop point, the viewpoint position, and the position of the image sensor 50. The zoom in button 131 is used to move the viewpoint position close to the needle drop point. The zoom out button 132 is used to move the viewpoint position away from the needle drop point. If the zoom in button 131 is pressed, an interval between the concentric circles 121 becomes larger in the viewpoint position display region 120 in order to show that the viewpoint position has been moved closer to the needle drop point. In addition, a zoomed-in image is displayed in the image display region 104. If the zoom out button 132 is pressed, the interval between the concentric circles 121 becomes smaller in the viewpoint position display region 120 in order to show that the viewpoint position has been moved away from the needle drop point. In addition, a zoomed-out image is displayed in the image display region 104. Therefore, the user can easily know a distance relationship between the needle drop point and the viewpoint position. The specific viewpoint button 133 is used to specify a specific position which is rightward from the needle drop point as the viewpoint position. The close button 134 is used to exit the viewpoint conversion.

Subsequently, the CPU 61 determines whether the close button 134 is operated (step S24). If the close button 134 is operated (YES at step S24), the CPU 61 returns to processing of step S11. If the close button 134 is not operated (NO at step S24), the CPU 61 determines whether a viewpoint change is instructed by operating any of the above-mentioned buttons other than the close button 134 by the user (step S25). If the viewpoint change is not instructed (NO at step S25), the CPU 61 returns to the determination of step S24.

Figure 10:
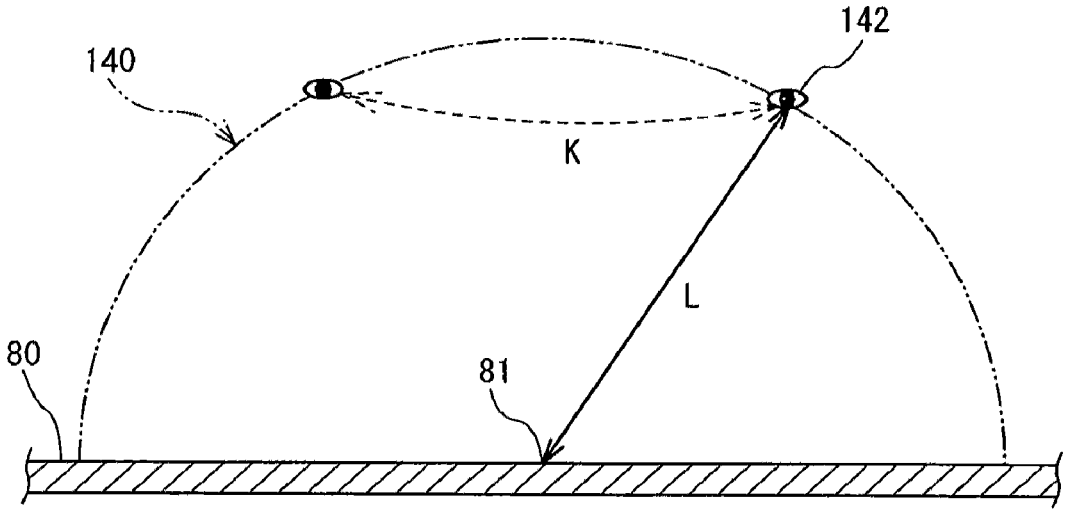
FIG. 10 is an explanatory illustration that shows movement of a viewpoint position.

If the viewpoint change is instructed (YES at step S25), viewpoint position change processing is performed (step S26). In the viewpoint position change processing, if at least any one of the up button 111, the down button 112, the left button 113, and the right button 114 is operated, a viewpoint position 142 is moved as indicated by arrow "K" on a virtual spherical surface 140 having a needle drop point 81 as the center, as shown in FIG. 10. Accordingly, the viewpoint mark 122 is moved in the viewpoint position display region 120 (see FIG. 9). Therefore, the user can easily know a change in positional relationship among the needle drop point, the viewpoint position, and the position of the image sensor 50. Coordinates of the moved viewpoint position are stored in the changed viewpoint coordinates storage area of the RAM 63. If the reset button 115 is operated, the image that is displayed in the image display region 104 is changed from the virtual image to the real image, and the viewpoint mark 122 is moved to the position of the camera mark 123 in the viewpoint position display region 120.

If the zoom in button 131 is operated, a distance between the needle drop point 81 and the viewpoint position 142 is decreased as indicated by arrow "L," as shown in FIG. 10. Accordingly, the interval between the concentric circles 121 in the viewpoint position display region 120 (see FIG. 9) becomes larger, and coordinates of the moved viewpoint position are stored in the changed viewpoint coordinates storage area of the RAM 63. If the zoom out button 132 is operated, the viewpoint position 142 is moved away from the needle drop point 81. Accordingly, the interval between the concentric circles 121 becomes smaller in the viewpoint position display region 120.

If the specific viewpoint button 133 is operated, the viewpoint position is changed to a specific position 85 in a space surrounded by the sewing machine bed 2, the pillar 3, and the arm 4, as shown in FIG. 1, and the viewpoint mark 122 is moved. Therefore, the user can readily know where the viewpoint position is changed. The coordinates of the moved viewpoint position are stored in the RAM 63. The specific position 85 is a viewpoint position that is located substantially at the midsection on the left side surface of the pillar 3, and the right side of the needle drop point may be viewed from the specific position 85. Accordingly, when the user wants to confirm a sewn state from the right side of a needle drop point in the case of, for example, performing overcasting stitches along an edge of a work cloth, the user can observe the sewn state by displaying by a simple operation an image that cannot be seen with the user's eyes in the image display region 104. Although the specific position 85 is set substantially to the midsection on the left side surface of the pillar 3 in the present embodiment, the specific position may be set as required. Following the viewpoint position change processing (step S26), image data conversion processing is carried out (step S27).

The image data conversion processing (step S27) will be described below. In the image data conversion processing, a virtual image as viewed from a viewpoint position specified by the user is generated from a real image by the viewpoint conversion. First, it is assumed that three-dimensional coordinates of a point in the above-described world coordinate system that indicates a whole of space are $M_w(X_w, Y_w, Z_w)$, three-dimensional coordinates of a point in the camera coordinate system of the image sensor 50 are $M_1(X_1, Y_1, Z_1)$, and three-dimensional coordinates of a point in a coordinate system with respect to the specified viewpoint position are $M_2(X_2, Y_2, Z_2)$. The coordinate system with respect to the specified viewpoint position is hereinafter referred to as a "moved-viewpoint coordinate system." It is also assumed that the two-dimensional coordinates of a point on a real image plane in the camera coordinate system are $(u_1, v_1)$ and the two-dimensional coordinates of a point on a virtual image plane in the moved-viewpoint coordinate system are $(u_2, v_2)$. $R_w$ is a 3×3 rotation matrix that is determined based on an X-axial rotation vector $r_1$, a Y-axial rotation vector $r_2$, and a Z-axial rotation vector $r_3$, which are the external parameters. $t_w$ is 3×1 translation vector that is determined based on an X-axial translation vector $t_1$, a Y-axial translation vector $t_2$, and a Z-axial translation vector $t_3$, which are the external parameters. $R_w$ and $t_w$ are used to convert the three-dimensional coordinates $M_w(X_w, Y_w, Z_w)$ in the world coordinate system into the three-dimensional coordinates $M_1(X_1, Y_1, Z_1)$ in the camera coordinate system. When the three-dimensional coordinates $M_w(X_w, Y_w, Z_w)$ in the world coordinate system are converted into three-dimensional coordinates $M_2(X_2, Y_2, Z_2)$ in the moved-viewpoint coordinate system, $R_{w2}$(3×3 rotation matrix) and $t_{w2}$ (3×1 translation vector) are used. $R_{w2}$ and $t_{w2}$ are determined based on which point in the world coordinate system corresponds to a specified viewpoint position. Determinants that are used to convert the three-dimensional coordinates $M_2(X_2, Y_2, Z_2)$ in the moved-viewpoint coordinate system into the three-dimensional coordinates $M_1(X_1, Y_1, Z_1)$ in the camera coordinate system is assumed to be $R_{21}$ (3×3 rotation matrix) and $t_{21}$(3×1 translation vector).

First, the CPU 61 calculates the determinants $R_{21}$ and $t_{21}$, which are used to convert the three-dimensional coordinates $M_2(X_2, Y_2, Z_2)$ in the moved-viewpoint coordinate system into the three-dimensional coordinates $M_1(X_1, Y_1, Z_1)$ in the camera coordinate system. The following equations hold true among $R_w$, $R_{w2}$, $R_{21}$, $t_w$, $t_{w2}$, and $t_{21}$: $M_1=R_w\times M_w+t_w$ (conversion from the world coordinate system into the camera coordinate system), $M_2=R_{w2}\times M_w+t_{w2}$ (conversion from the world coordinate system into the moved-viewpoint coordinate system), and $M_1=R_{21}\times M_2+t_{21}$ (conversion from the moved-viewpoint coordinate system into the camera coordinate system). Solving these equations for $R_{21}$ and $t_{21}$ results in $R_{21}=R_w\times R_{w2}^T$ and $t_{21}=R_w\times R_{w2}^T\times t_{w2}+t_w$. Since $R_w$, $R_{w2}$, $t_w$, and $t_{w2}$ are fixed values that have already been calculated, $R_{21}$ and $t_{21}$ are uniquely determined.

Next, the CPU 61 generates a virtual image by calculating two-dimensional coordinates $(u_1, v_1)$ in the real image which correspond to the two-dimensional coordinates $(u_2, v_2)$ of a point in the virtual image. Therefore, the two-dimensional coordinates $(u_2, v_2)$ in the virtual image are converted into two-dimensional coordinates $(x_2'', y_2'')$ in a normalized image in the moved-viewpoint coordinate system. The coordinates $(x_2'', y_2'')$ are obtained as $x_2''=(u_2-cx)/fx$ and $y_2''=(v_2-cy)/fy$ with the X-axial focal length fx, the Y-axial focal length fy, the X-axial principal point coordinate cx, and the Y-axial principal point coordinate cy, which are stored in the internal parameter storage area 642 of EEPROM 64. Subsequently, coordinates $(x_2'', y_2'')$, are calculated from the two-dimensional coordinates $(x_2'', y_2'')$ in the normalized image in view of the strain of the lens. The coordinates $(x_2'', y_2'')$ are obtained as $x_2'=x_2''-x_2''\times(1+k_1\times r^2+k_2\times r^4)$ and $y_2'=y_2''-y_2''\times(1+k_1\times r^2+k_2\times r^4)$ with the first coefficient of strain $k_1$ and the second coefficient of strain $k_2$, which are internal parameters. In this case, the equation $r^2=x_2''^2+y_2''^2$ holds true.

Subsequently, the three-dimensional coordinates $M_2(X_2, Y_2, Z_2)$ in the moved-viewpoint coordinate system are calculated from the two-dimensional coordinates $(x_2', y_2')$ in the normalized image in the moved-viewpoint coordinate system. The equations $X_2=x_2'\times Z_2$ and $Y_2=y_2'\times Z_2$ hold true. Further, since the upper surface of the sewing machine bed 2 is set as the XY plane in the world coordinate system, $Z_w=0$ is set in $M_2=R_{w2}\times M_w+t_{w2}$. By solving the simultaneous equations, the three-dimensional coordinates $(X_2, Y_2, Z_2)$ in the moved-viewpoint coordinate system are calculated.

Then, the three-dimensional coordinates $M_2(X_2, Y_2, Z_2)$ in the moved-viewpoint coordinate system are converted into the three-dimensional coordinates $M_1(X_1, Y_1, Z_1)$ in the camera coordinate system. $M_2(X_2, Y_2, Z_2)$ are substituted into the equation of $M_1=R_{21}\times M_2+t_{21}$, and then $M_1(X_1, Y_1, Z_1)$ is calculated. Subsequently, the three-dimensional coordinates $M_1(X_1, Y_1, Z_1)$ in the camera coordinate system are converted into two-dimensional coordinates $(x_1'', y_1'')$ in the normalized image in the camera coordinate system. The equations $x_1'=x_1/z_1$ and $y_1'=y_1/z_1$ hold true. Further, two-dimensional coordinates ($x_1''$, $y_1''$) are calculated in view of the strain of the lens. The coordinates ($x_1''$, $y_1''$) are obtained as $x_1''=x_1'\times(1+k_1\times r^2+k_2\times r^4)$ and $y_1''=y_1'\times(1+k_1\times r^2+k_2\times r^4)$. In this case, the equation $r^2=x_1''^2+y_1''^2$ holds true. Subsequently, the two-dimensional coordinates ($x_1''$, $y_1''$) in the normalized image are converted into two-dimensional coordinates ($u_1$, $v_1$) in the camera coordinate system. The coordinates ($u_1$, $v_1$) are obtained as $u_1=fx\times x_1''+cx$ and $v_1=fy\times y_1''+cy$.

The above processing is performed on all of the pixels of a virtual image, so that the correspondence relationship between a pixel ($u_1$, $v_1$) of a real image and a pixel ($u_2$, $v_2$) of the virtual image is determined. Thus, the virtual image as viewed from a viewpoint position that is specified by the user may be generated from the real image. Following the image data conversion processing (step S27), the CPU 61 displays the virtual image that is generated by the viewpoint conversion in the image display region 104 (step S28) and returns to the determination of step S24, in the image display processing shown in FIG. 6.

Figure 11:
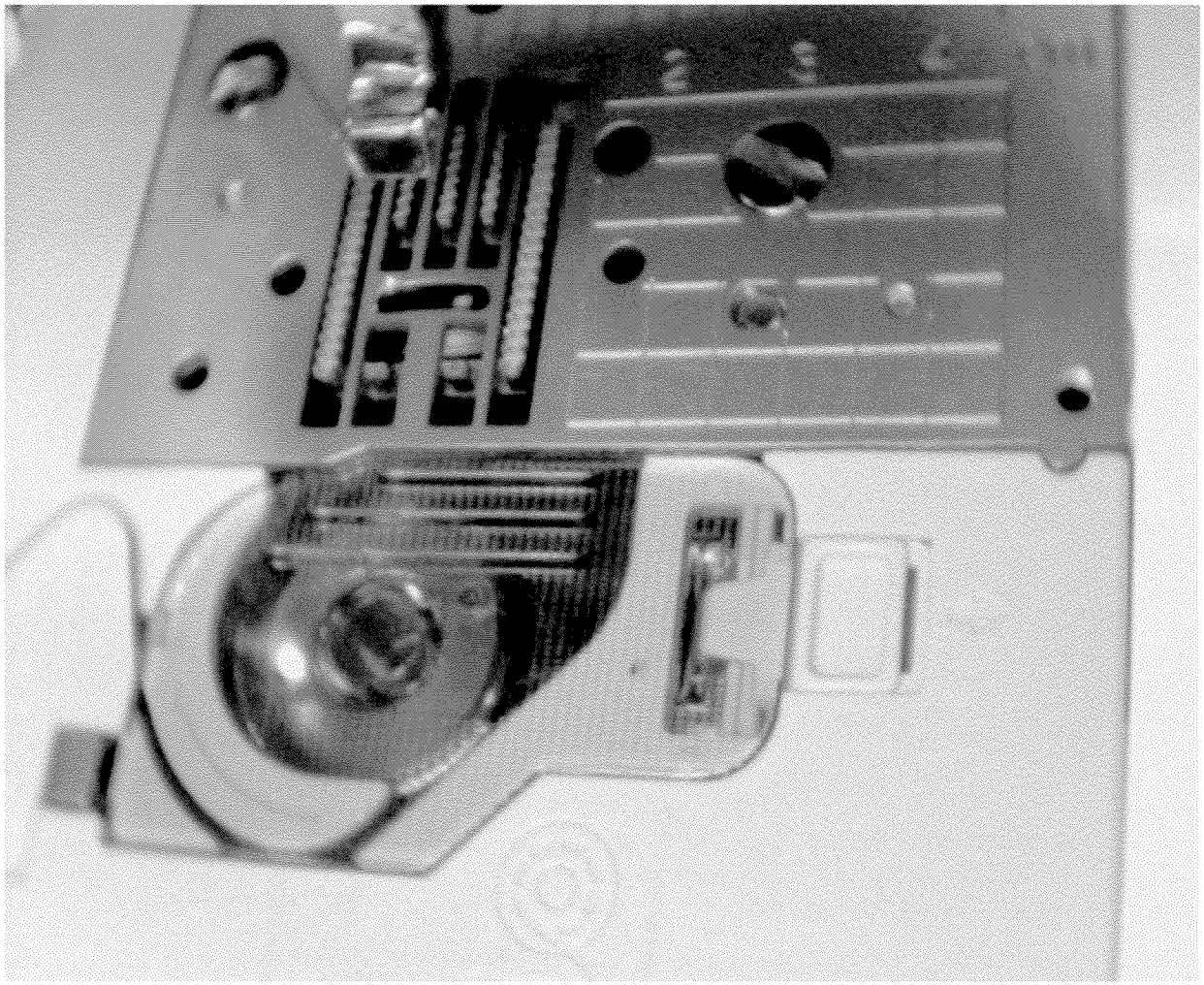
FIG. 11 is an illustration that shows an example of a real image of a needle plate that is picked up by the image sensor.
Figure 12:
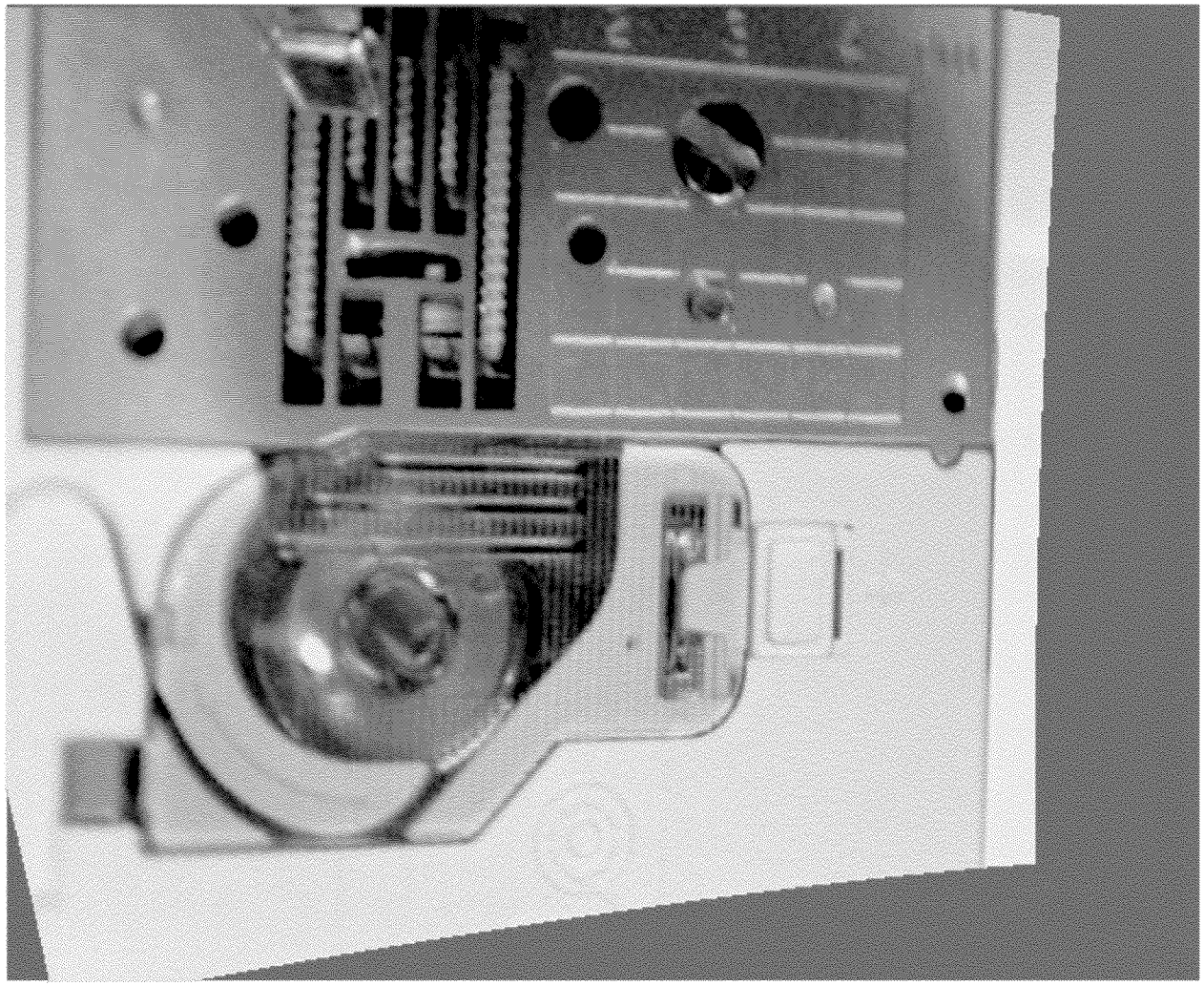
FIG. 12 is an illustration that shows an example of a virtual image generated by viewpoint conversion from the real image shown in FIG. 11.

The following will describe a real image picked up by the image sensor 50 of the present embodiment and a virtual image generated from the real image by the viewpoint conversion, with reference to FIGS. 11 and 12. A real image shown in FIG. 11 is an image of the needle plate 80 picked up from obliquely above. In the first processing of displaying an image in the image display processing (step S15 in FIG. 6), a real image picked up by the image sensor 50 is displayed as it is, as shown in FIG. 11. When a viewpoint position is changed according to an instruction from the user (step S26), a virtual image as viewed from the changed viewpoint position is generated from the real image by viewpoint conversion (step S27), and the processing to display the generated virtual image is performed (step S28). Thus, as shown in FIG. 12, the image as viewed from the viewpoint position specified by the user is displayed in the image display region 104. The virtual image generated by viewpoint conversion shown in FIG. 12 is an image as viewed substantially from just above the needle plate 80.

As described above, in the sewing machine 1 of the present embodiment, it is possible to generate a virtual image as viewed from a user-desired viewpoint position by viewpoint conversion from a real image picked up by the image sensor 50 and display the generated virtual image on the LCD 10. Accordingly, the user can confirm a needle position and a sewn state from an arbitrary viewpoint without actually observing the needle bar 6 and the vicinity of the needle bar 6, even in a case where many image sensors 50 are not disposed on the sewing machine 1 or the image sensor 50 is moved. Further, the user can easily confirm the needle position and the sewn condition even from a position where it may be impossible or difficult for the user to observe the needle position and the sewn condition, by viewing a virtual image as viewed from the changed viewpoint position without changing the user's actual viewpoint.

The sewing machine according to the present disclosure is not limited to the above embodiment and may be changed variously without departing from the gist of the present disclosure. In the above embodiment, an image sensor 50 is placed at the lower end portion 60 (see FIGS. 2 and 3) of the front surface cover 59 in order to pick up an image of the sewing machine bed 2. However, the position where the image sensor 50 is disposed and the number of the image sensor 50 may be changed as needed. For example, images picked up by two image sensors 50 may be used to generate a virtual image, and the generated virtual image may be displayed on the LCD 10.

A configuration to receive the user's entry of the viewpoint position of the virtual image may be changed. As shown in FIG. 9, the present embodiment provides the buttons 111-114, which are used to move the viewpoint position in a user-desired direction, the reset button 115, which is used to change a displayed image from a virtual image to a real image, and the specific viewpoint button 133, which is used to move the viewpoint position to a specific position. However, instead of providing the buttons 111-114, a plurality of viewpoint position specification buttons to move the viewpoint position to a predetermined position (for example, backward, leftward, rightward, and forward) may be provided so that the user can select one of a plurality of the viewpoint positions. In such a case, the user can specify a specific position by a simple operation as the viewpoint position. At least two kinds of the specific viewpoint button 133 may be provided. The reset button 115 may be omitted. Instead of a touch panel 16, a dedicated input portion that is configured to receive an entry of a viewpoint position may be provided. A pointing device such as a mouse, a trackpad, a trackball, or a joystick may be connected to the sewing machine 1, and the viewpoint position may be moved by operating the pointing device.

In the present embodiment, in the case of enlarging an image of a predetermined position to be displayed in the image display region 104, instead of scaling up the image, the image is displayed in a larger size by bringing the viewpoint position close to a needle drop point. That is, rather than scaling up and down the image, the image is zoomed in and out with parameters. However, the real image or the virtual image may be scaled up or down to be displayed in the image display region 104.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a bed portion;

a pillar portion that is erected upward from the bed portion;

an arm portion that extends horizontally from the pillar portion above the bed portion;

a head that is provided at an end of the arm portion;

a needle bar that is attached to the head and can reciprocate up and down, and the needle bar is configured to hold a sewing needle;

an image pickup device that can pick up an image of an upper surface of the bed portion;

an image conversion device that generates a virtual image from a real image by viewpoint conversion, the virtual image being an image as viewed from an arbitrary viewpoint position, and the real image being an image picked up by the image pickup device, wherein the image conversion device performs the viewpoint conversion using an internal parameter and an external parameter;

an image display device that displays an image; and an image display control device that displays the virtual image generated by the image conversion device on the image display device, wherein the image display control device causes the image display device to display one of the real image and the virtual image by switching between the real image and the virtual image based on a viewpoint conversion command.

2. The sewing machine according to claim 1, further comprising a viewpoint position specification device that specifies a spatial position as the viewpoint position, wherein the image conversion device generates the virtual image as viewed from the viewpoint position specified by the viewpoint position specification device.

3. The sewing machine according to claim 2, further comprising:

a layout display device that displays concentric circles, a first mark, and a second mark, the concentric circles having a reference position on the bed portion as the center of the concentric circles and indicating a distance relationship between the reference position and a periphery, the first mark indicating an image pickup device position at which the image pickup device is disposed, and the second mark indicating the viewpoint position; and a layout display control device that displays the first mark and the second mark on the concentric circles in a layout corresponding to a positional relationship among the reference position, the image pickup device position, and the viewpoint position, wherein in a case where the viewpoint position is specified by the viewpoint position specification device, the layout display control device displays the second mark at a position corresponding to the specified viewpoint position on the layout display device.

4. The sewing machine according to claim 1, further comprising a specific viewpoint position specification device that specifies a predetermined position as the viewpoint position.

5. The sewing machine according to claim 4, wherein the predetermined position is a position in a space that is surrounded by the bed portion, the pillar portion, and the arm portion.

6. The sewing machine according to claim 1, further comprising:

a layout display device that displays concentric circles, a first mark, and a second mark, the concentric circles having a reference position on the bed portion as the center of the concentric circles and indicating a distance relationship between the reference position and a periphery, the first mark indicating an image pickup device position at which the image pickup device is disposed, and the second mark indicating the viewpoint position; and a layout display control device that displays the first mark and the second mark on the concentric circles in a layout corresponding to a positional relationship among the reference position, the image pickup device position, and the viewpoint position.

7. The sewing machine according to claim 6, further comprising a distance change device that changes a distance between the reference position and the viewpoint position, wherein:

an interval between the concentric circles is increased if the distance is decreased by the distance change device; and the interval between the concentric circles is decreased if the distance is increased by the distance change device.

8. The sewing machine according to claim 1, wherein the image pickup device is disposed at a position on the head, frontward of the needle bar, and at a predetermined distance from a thread guide path, the thread guide path leading a needle thread to the sewing needle.

9. A non-transitory computer-readable medium storing a control program executable on a sewing machine, the program comprising instructions that cause a controller to:

acquire a real image that is a picked-up image of an upper surface of a bed portion of the sewing machine;

generate a virtual image as viewed from an arbitrary viewpoint position from the acquired real image by viewpoint conversion, wherein the viewpoint conversion is performed by using an internal parameter and an external parameter; and display the generated virtual image, wherein one of the real image and the virtual image is displayed by switching between the real image and the virtual image based on a viewpoint conversion command.

10. The non-transitory computer-readable medium according to claim 9, wherein:

the program further comprises instructions that cause the controller to receive a specification to specify a spatial position as a viewpoint position; and the virtual image as viewed from the viewpoint position specified by the received specification is generated.

11. The non-transitory computer-readable medium according to claim 10, wherein:

the program further comprises instructions that cause the controller to display a first mark and a second mark on concentric circles in a layout corresponding to a positional relationship among a reference position, an image pickup device position, and a viewpoint position, the first mark indicating the image pickup device position at which the image pickup device is disposed, the second mark indicating the viewpoint position, the reference position being on the bed portion, the concentric circles having the reference position as the center of the concentric circles and indicating a distance relationship between the reference position and a periphery; and the second mark is displayed at a position corresponding to the specified viewpoint position in a case where the specification is received.

12. The non-transitory computer-readable medium according to claim 9, wherein:

the program further comprises instructions that cause the controller to receive a specification to specify a predetermined position as the viewpoint position;

the program further comprises instructions that cause the controller to display a first mark and a second mark on concentric circles in a layout corresponding to a positional relationship among a reference position, an image pickup device position, and a viewpoint position, the first mark indicating the image pickup device position at which the image pickup device is disposed, the second mark indicating the viewpoint position, the reference position being on the bed portion, the concentric circles having the reference position as the center of the concentric circles and indicating a distance relationship between the reference position and a periphery; and the second mark is displayed at a position corresponding to the predetermined position in a case where the specification is received.

13. The non-transitory computer-readable medium according to claim 9, wherein the program further comprises instructions that cause the controller to display a first mark and a second mark on concentric circles in a layout corresponding to a positional relationship among a reference position, an image pickup device position, and a viewpoint position, the first mark that indicating the image pickup device position at which the image pickup device is disposed, the second mark indicating the viewpoint position, the reference position being on the bed portion, the concentric circles having the reference position as the center of the concentric circles and indicating a distance relationship between the reference position and a periphery.

14. The non-transitory computer-readable medium according to claim 13, wherein:

the program further comprises instructions that cause the controller to change a distance between the reference position and the viewpoint position;

an interval between the concentric circles is increased if the distance is decreased; and the interval between the concentric circles is decreased if the distance is increased.

15. A sewing machine comprising:

a bed portion;

a pillar portion that is erected upward from the bed portion;

an arm portion that extends horizontally from the pillar portion above the bed portion;

a head that is provided at an end of the arm portion;

a needle bar that is attached to the head and can reciprocate up and down, and the needle bar is configured to hold a sewing needle;

an image pickup device that can pick up an image of an upper surface of the bed portion;

an image conversion device that generates a virtual image from a real image by viewpoint conversion, the virtual image being an image as viewed from an arbitrary viewpoint position, and the real image being an image picked up by the image pickup device, wherein the image conversion device performs the viewpoint conversion using an internal parameter external parameter;

an image display device that displays an image; and an image display control device that displays the virtual image generated by the image conversion device on the image display device, wherein the virtual image is an image at a viewpoint position that is different than a viewpoint position of the real image.

16. The sewing machine according to claim 15, further comprising a viewpoint position specification device that specifies a spatial position as the viewpoint position, wherein the image conversion device generates the virtual image as viewed from the viewpoint position specified by the viewpoint position specification device.

17. The sewing machine according to claim 16, further comprising:

a layout display device that displays concentric circles, a first mark, and a second mark, the concentric circles having a reference position on the bed portion as the center of the concentric circles and indicating a distance relationship between the reference position and a periphery, the first mark indicating an image pickup device position at which the image pickup device is disposed, and the second mark indicating the viewpoint position; and a layout display control device that displays the first mark and the second mark on the concentric circles in a layout corresponding to a positional relationship among the reference position, the image pickup device position, and the viewpoint position, wherein in a case where the viewpoint position is specified by the viewpoint position specification device, the layout display control device displays the second mark at a position corresponding to the specified viewpoint position on the layout display device.

18. The sewing machine according to claim 15, further comprising a specific viewpoint position specification device that specifies a predetermined position as the viewpoint position.

19. The sewing machine according to claim 18, wherein the predetermined position is a position in a space that is surrounded by the bed portion, the pillar portion, and the arm portion.

20. The sewing machine according to claim 15, further comprising:

a layout display device that displays concentric circles, a first mark, and a second mark, the concentric circles having a reference position on the bed portion as the center of the concentric circles and indicating a distance relationship between the reference position and a periphery, the first mark indicating an image pickup device position at which the image pickup device is disposed, and the second mark indicating the viewpoint position; and a layout display control device that displays the first mark and the second mark on the concentric circles in a layout corresponding to a positional relationship among the reference position, the image pickup device position, and the viewpoint position.

21. The sewing machine according to claim 20, further comprising a distance change device that changes a distance between the reference position and the viewpoint position, wherein:

an interval between the concentric circles is increased if the distance is decreased by the distance change device; and the interval between the concentric circles is decreased if the distance is increased by the distance change device.

22. The sewing machine according to claim 15, wherein the image pickup device is disposed at a position on the head, frontward of the needle bar, and at a predetermined distance from a thread guide path, the thread guide path leading a needle thread to the sewing needle.

* * * * *